United States Patent [19]

Borca et al.

[11] 4,229,119

[45] Oct. 21, 1980

[54] LIFTABLE AND COLLAPSIBLE BARRAGE

[75] Inventors: Bruno Borca, Milan; Francesco Calza, Monza, both of Italy

[73] Assignee: Pirelli Furlanis—Applicazioni Idrauliche Agricole Gomma S.p.A., Italy

[21] Appl. No.: 897,750

[22] Filed: Apr. 17, 1978

[30] Foreign Application Priority Data

May 31, 1977 [IT] Italy ..... 24178 A/77

[51] Int. Cl.[2] ..... E02B 7/20

[52] U.S. Cl. ..... 405/96; 405/91

[58] Field of Search ..... 61/22, 25, 26, 28, 29; 405/87, 91, 92, 96, 97, 115

[56] References Cited

U.S. PATENT DOCUMENTS

| | | | |
|---|---|---|---|
| 1,080,944 | 12/1913 | Baker | 61/29 |
| 1,237,107 | 8/1917 | Shaffer | 61/29 |
| 1,257,240 | 2/1918 | Jaycox | 61/26 |
| 1,784,955 | 12/1930 | Ballard | 61/29 |

FOREIGN PATENT DOCUMENTS

| | | | |
|---|---|---|---|
| 1252595 | 10/1967 | Fed. Rep. of Germany | 61/29 |

*Primary Examiner*—David H. Corbin

*Attorney, Agent, or Firm*—Stevens, Davis, Miller & Mosher

[57] ABSTRACT

An artificial dam or barrage which is adapted to be moved vertically from the bottom of the waterway in which it is installed is provided with a sheet of flexible material fixed to the bottom of the waterway and suspended with flexible cables above the bottom of the waterway.

3 Claims, 3 Drawing Figures

LIFTABLE AND COLLAPSIBLE BARRAGE

This invention relates to a barrage, artificial dam or sluice-gate and the like for waterways such as canals, rivers and the like which can be raised and lowered. More particularly, the present invention relates to such structures which can be raised and lowered of the type including a flexible and inextensible sheet bonded water-tight by its own edges to the bottom and banks of the waterway, and with its remaining edge raised some distance from the bottom.

Various barrages of the type which can be raised and lowered, as described above in general terms, are known, and differ from each other in the form of the sheet and above all in the special means used to keep the free edge of the sheet clear of the bottom, that is, the edge which is not secured to the bottom and the banks of the waterway.

In a known barrage of the type in question the means used to keep the free edge raised from the bottom consists substantially of a beam arranged transversely relative to the waterway and supported at its ends on the sides of the waterway to which the free edge of the sheet is fixed.

In another known barrage the means adopted to hold the free edge of the sheet at a distance from the bottom consists of a system of tie rods permanently fixed to the sides of the waterway upstream of the barrage.

The known barrages described above have numerous disadvantages. One disadvantage of the known barrage is that of not being adaptable to create differences in the water level in waterways of various dimensions, since the sheet of flexible inextensible material would be subjected to localized stresses at points which could not be safely determined, and of values such as to lead to the immediate breakdown of the fabric itself. The attempts made to avoid the drawback now mentioned have led to the design of fabrics with reinforcement and stiffening in particular parts, introducing considerable complexity in the manufacture of the fabrics, but also these devices do not provide safety to the known barrages.

Another disadvantage of the known barrages is that of not allowing rapid lowering of the sheet to avoid excessive stressing due, for example, to the arrival of flood water, and of not allowing the total contact of the sheet with the bottom and the banks of the waterway with the barrage lowered.

A further drawback of known barrages is their inability to allow accurate control of the level of water in the basin upstream of the barrage.

An object of the present invention is to avoid all the disadvantages listed above of the known barrages and to provide a barrage suitable to be installed with safety in a waterway of any size, to allow full and accurate control of the level of water in the basin upstream of the barrage. Another object of the invention is to provide a barrage which when lowered does not obstruct the waterway in which it is positioned.

Figure 1:
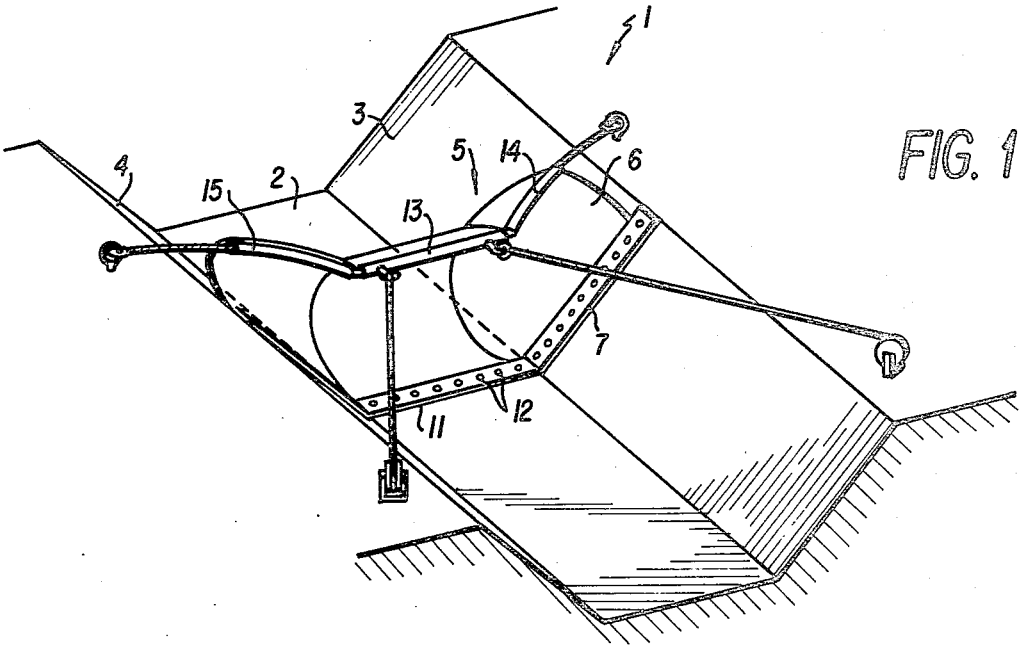
Figure 2:
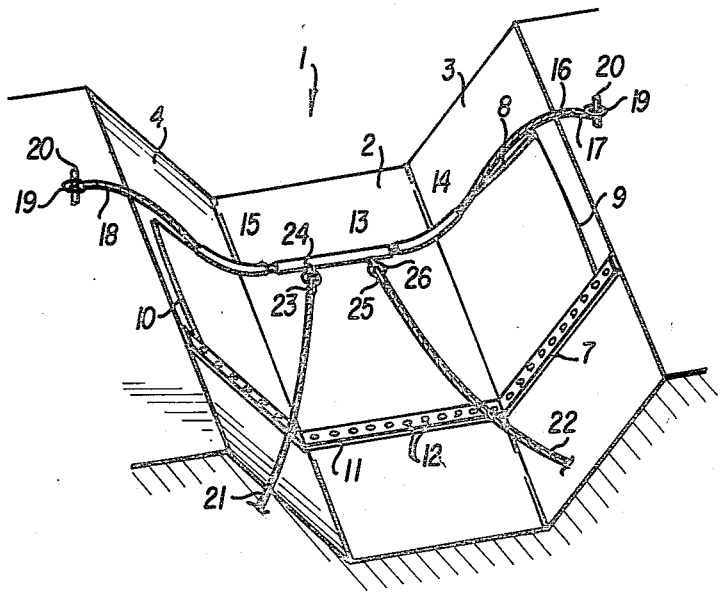
Figure 3:
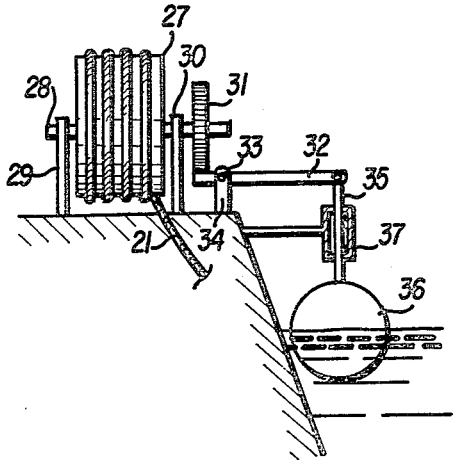

Other objects will become apparent from the following description with reference to the drawings wherein FIG. 1 is a perspective view of a length of a canal provided with a barrage of the invention, in the raised position;

FIG. 2 is a perspective view of a length of a canal provided with a barrage of the invention in a lowered position; and FIG. 3 illustrates on an enlarged scale a detail of the operating system of the barrage.

The foregoing objects and others are accomplished in accordance with this invention by providing a barrage which can be raised and lowered, for canals and the like, comprising a flexible and inextensible sheet, means for the continuous water-tight fixing of the sheet along one edge to the bottom, and to the banks of the canal, and means to suspend the side of the sheet opposite to that secured to the bottom and to the banks of the canal at a distance from the bottom of the canal, characterized in that the means for suspending the said side of the sheet include a system of cables fixed to the banks of the canal upstream of the barrage, a system of ties fixed to the banks of the canal downstream of the barrage, and means to vary the length of the series of ties fixed to the banks of the canal upstream of the barrage.

Referring now to FIGS. 1 and 2, an embodiment of a barrage of the present invention which can be raised and lowered is illustrated.

As can be seen in FIGS. 1 and 2, in a canal 1 with a bottom 2 and two banks 3 and 4, a barrage 5 is arranged. The barrage 5 comprises a flexible inextensible sheet 6 of rubberized fabric, for example, with a rectangular shape, and having four sides 7, 8, 9 and 10, and in general of quadrilateral shape and also, for example, trapezoidal. The sides 7 and 8, which are generally the sides of larger dimensions, have a length substantially equal to the shape of the transverse section of the canal. The sides 9 and 10 which are those of the smaller dimensions, have a length not less than the depth of the canal. The flexible inextensible sheet 6 is securely fixed water-tight to the bottom 2 and to the banks 3 and 4 of the canal along its own side 7 by known means, for example, the attachment of the sheet 6 to the bottom 2 and banks 3 and 4 of the canal can be made by means of a metal bar 11 which presses the side 7 of the sheet 6 against the bottom and the banks. A series of bolts 12 fasten the sheet 6 and bar 11 to the sides 3 and 4 and bottom 2. Corresponding with the side 8 of the sheet, and specifically corresponding with the central part of the said side, a rigid tubular element is firmly fixed, in the form for example, of a length of metallic tube or pipe 13.

Lengths of flexible tubing 14 and 15 are fixed to the side 8 of the sheet 6 at both ends of metallic tube 13. As regards the length of the metallic tube 13 and the lengths 14 and 15 of flexible tube, the dimensions are not critical, and therefore they can be varied. Preferably, and purely by way of example, the metallic tube 13 has a length equal to the width of the bottom of the canal, and the flexible tubes 14 and 15 have a length equal to the height of the banks of the canal.

A flexible and inextensible steel cable 16 passes through metallic tube 13 and the flexible tubes 14 and 15 with a length at least equal to the length of the contoured section of the canal made transversely across the canal itself.

The ends 17 and 18 of the cable 16 are firmly fixed to the edges of the canal in any known manner, for example, by inserting two ends 19 formed at the ends of the cable in posts 20 fixed in the said sides of the canal. Alternatively, the ends 17 and 18 of the cable 16 can be fixed to the banks of the canal by means not shown, which allow the length of the cable between the banks of the canal to be varied. The positions in which the ends 17 and 18 of the cable 16 are fixed to the sides of the canal are downstream of the barrage 5. To be precise, downstream of the fixing zone of the sheet 6 along the side 7 at the bottom and sides of the canal at a distance equal to the length of the sides 9 or 10 of the said sheet 6.

As can be clearly seen in FIG. 1, the assembly constituted by the cable 16, the rigid metal tube 13, and the flexible tubes 14 and 15, forms a system of cables fixed to the sides of the canal downstream of the barrage. It can be seen in FIGS. 1 and 2 that the ends of the two flexible and inextensible cables 21 and 22 are firmly fixed to the rigid metallic tube 13, and have their other ends fixed to the sides of the canal upstream of the dam, and the assembly of the said cables 21 and 22 forms a system of ties fixed upstream of the barrage.

In another embodiment, not shown, the cables 21 and 22 have their ends opposite to those connected to the rigid tube 13 fixed to a bar arranged transversely relative to the canal so as to optimize the flow of stress in the whole of the barrage structure.

In more detail, the cable 21 is fixed to the rigid tube 13 by inserting a loop 23 carried on the end of cable 21, into an eye 24 fixed firmly to the rigid tube 13. The other end of the cable 21 is fixed to the side of the canal corresponding to the bank 4 by means which allow the length of the cable included between the bank 4 and the rigid tube 13 to be varied, as described in detail below.

Similarly, the cable 22 is fixed to the rigid tube 13 by inserting a loop 25 carried on the end of cable 22 into an eye 26 firmly fixed to the rigid tube 13. The other end of cable 22 is fixed at the side of the canal corresponding to the bank 3 by means which allow the length of the cable included between the bank 3 and the rigid tube 13 to be varied, as described in detail below.

Obviously, in the case where the ends of the cables 21 and 22 opposite to those connected to the tube 13, are fixed to a bar arranged transversely relative to the canal, the means described in detail below, to vary the length of the cables 21 and 22, are carried by the bar.

The means are shown on an enlarged scale in FIG. 3 with which the variation of the length of cable 21 (or 22) is achieved, and which allow the rapid release of the cable to lower the barrage 5 with a control adjusted as a function of the level of the water upstream of the barrage.

As is seen in FIG. 3, the means which allow the variation of the length of the section of cable 21 (or 22) included between the bank and the rigid tube 13 and the rapid release of the cable, comprise a drum 27 rotating around its axis on which the cable 21 is partly coiled and to which the end of the cable 21 opposite to the end fixed to the rigid tube 13, is firmly fixed. The drum 27 has, corresponding to its own axis of rotation, a shaft 28, the ends of which are carried by standards 29 and 30 and project beyond the standard 30 which is nearest to the canal.

On the part of shaft 28 outside the standard 30 is fixed a wheel 31 provided on its periphery with a series of notches into which is inserted the end of a lever 32 hinged at 33 to a projecting part 34 and cantilevered from the canal bank. A rod 35 is hinged to the other end of lever 32 and is supported on the cantilever by a float 36, and the rod 35 is slidably located in a guide 37 fixed to the canal bank.

Furthermore, corresponding to the end of shaft 28 at the standard 29 end, a motor is provided (not shown) to wind the cable 21 onto the drum 27 to shorten the length of the cable 21 included between the rigid tube 13 and the canal bank. Of course, the means now described to vary the length of the cables 21 and 22 are not intended to be limitative and it is intended that other means to achieve the same result are to be included within the scope of the present invention.

The mode of operation of the barrage described above is as follows. In the condition when the barrage is raised, which is shown in FIG. 1, it is seen that the barrage has a configuration constituted by a central length corresponding to the central zone in which the rigid tube 13 is present and in which the sheet 6 has a substantially cylindrical tile-shaped configuration, and by two lateral hopper-shaped lengths constituted by a smooth surface which finishes in correspondence with the banks with a straight-line segment and in correspondence with the tile configuration it connects with an arc of a circle.

The water can pass from the basin upstream to the basin downstream created by the barrage, flowing over the latter exclusively via the hopper-shaped zones, falling onto the banks 4 and 3 of the canal downstream of the barrage, or flowing over the barrage along its whole upper edge according to the level of the water in the upstream basin, which is adjusted by the system of cables fixed to the sides of the canal upstream of the said barrage.

In fact, if it is desired to raise the level of the water upstream of the barrage, it is sufficient to reduce the length of cables 21 and 22 between the rigid tube 13 and the sides of the canal; if, on the other hand, it is desired to reduce the level of water upstream of the barrage, it is sufficient to lenthen the cables 21 and 22 between the rigid tube and the canal sides.

Furthermore, where the cable 16 is also provided with means which allow its length to be changed, it is possible to vary the configuration of the side pieces in the shape of a hopper, of the barrage, achieving independence of the shape of the lateral sections from the adjustment of the central section of the barrage.

When it is desired to change from the raised position of the barrage, shown in FIG. 1, to the lowered position shown in FIG. 2, it is sufficient to release the drums 27 manually. In fact, when the drums 27 are released, the thrust of the water due to the difference in level between the basins upstream and downstream of the barrage allows the sheet 6 to adapt itself completely and perfectly to the base and the walls of the canal.

When, however, it is desired to change from the lowered condition of the barrage shown in FIG. 2 to the raised position shown in FIG. 1, it is sufficient to wind on to the drums 27 a length of the cables 21 and 22 to reduce the length of the cables 21 and 22 between the rigid tube and the sides of the canal, as a function of the level of water desired in the basin upstream of the barrage.

As stated earlier, the barrage according to the present invention provides means which allow the rapid release of the cables 21 and 22 for the rapid lowering of the barrage with a control adjusted as a function of the level of water upstream of the barrage and such means are shown in FIG. 3. The mode of operation of the means just mentioned above is as follows:

As the level of water in the upstream basin, created by the presence of the barrage, exceeds a prescribed safety level, as can occur, for example, with the arrival of flood water, the float 36 is raised relative to that seen in FIG. 3. When the float rises, the rod 35 rises with it, sliding in the fixed guide 37. The movement of the rod 35 causes the lever 32 to turn about its pivot 33 and therefore in consequence of this rotation the end of the lever 32, which first locked the wheel 31, releases the wheel 31 and then frees the drum 27, which rotates under the load applied by cable 21 in the direction which allows cable 21 to unwind.

From the description of the barrage according to the present invention and from its function, it is easy to understand how the objects of the invention are achieved.

In fact, considering the shape assumed by the sheet when the barrage is raised, it can be understood that the said sheet is not subjected to local points of stress, since no irregular creases form in the sheet which indicate the presence of the said points of localized stress. Furthermore, the possibility, when flood water arrives, of being able to lower the barrage rapidly, confers absolute safety on the latter, since, before overstressing can arise in the sheet, the barrage can be lowered.

Finally, the possibility of adjusting very precisely, continuously and simply, the level of water upstream of the barrage becomes evident from the moment it is obtainable simply by varying the length of the system of ties anchored to the banks upstream of the barrage.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. A barrage for a waterway which waterway has a bottom and a bank along each side, said barrage separating the waterway into upstream and downstream portions, said barrage being adapted to be raised and lowered and comprising a flexible inextensible sheet having a vertical length not less than the depth of the waterway and spanning the width of the waterway, continuous means for fixing the said sheet along one of its sides to the bottom of the waterway and to the side banks of the waterway in water-tight relations, a rigid tubular element and two flexible tubular elements fastened respectively to the central portion and to the two lateral portions of the side of the sheet opposite to that side of the sheet which is fixed to the bottom and side banks of the waterway, a flexible inextensible cable passing through said tubular elements, the ends of said cable are fixed to the side banks of the waterway downstream of the barrage, at least two flexible inextensible cables each having one extremity fixed to the rigid tubular element and other extremities fixed to opposite side banks of the waterway upstream of the barrage and means to vary the length of the cables fixed to the side banks of the waterway, said means to vary the length comprising a pair of drums respectively fixed on opposite side banks, each of said cables which are fixed to the side banks of the waterway upstream of the barrage having one end fixed to one of the drums, each said drum being provided with means for the rapid release of an associated cable fixed to the rigid tubular element controlled by the water level upstream of the barrage.

2. The barrage of claim 1 wherein said flexible sheet is rubberized fabric of ractangular shape and has four sides each having a length not less than the depth of the waterway.

3. The barrage of claim 1 wherein the means for the rapid release of a cable from a drum includes a floating element on the water in the basin upstream of the barrage and a rod supported by the said float, which, with its own free end can act on a lever to release the drum.

* * * * *